United States Patent [19]

Cordingley

[11] 3,994,497

[45] Nov. 30, 1976

[54] PLAYING FIELD AND BATTING APPARATUS

[76] Inventor: Richard P. Cordingley, 384 Middle St., East Weymouth, Mass. 02189

[22] Filed: Oct. 14, 1975

[21] Appl. No.: 622,164

[52] U.S. Cl. ..... 273/95 H; 273/102 R

[51] Int. Cl.[2] ..... A63B 71/02

[58] Field of Search ..... 273/52, 51, 95 R, 95 H, 273/101, 102 R, 102 S, 127 R

[56] References Cited

UNITED STATES PATENTS

| | | | |
|---|---|---|---|
| 2,035,975 | 3/1936 | Meyer | 273/52 |
| 2,520,392 | 8/1950 | Flenghi | 273/95 H |
| 2,683,603 | 7/1954 | Gackenbach | 273/95 H |
| 3,554,551 | 1/1971 | Apiki | 273/95 H |
| 3,802,703 | 4/1974 | Tassal | 273/95 H |
| 3,817,520 | 6/1974 | Burgos | 273/95 H |
| 3,822,883 | 7/1974 | DeVos | 273/95 H |

*Primary Examiner*—Anton O. Oechsle
*Assistant Examiner*—Marvin Siskind
*Attorney, Agent, or Firm*—Wolf, Greenfield & Sacks

[57] ABSTRACT

A baseball-like game apparatus includes a playing surface marked to define a triangular area defining a pair of foul lines and a defensive base line. Indicia are located within the triangle to define the placement locations of case or other objects which can be knocked over in a generally T-shaped configuration. The defensive team stands behind the base line and pitches the ball to the batter who attempts to hit the ball with the bat to knock over the cans.

8 Claims, 6 Drawing Figures

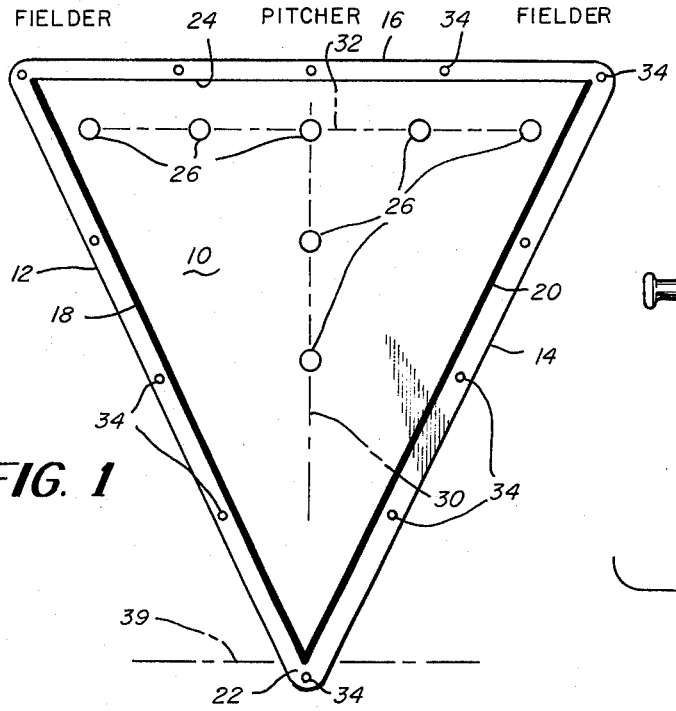
FIG. 1
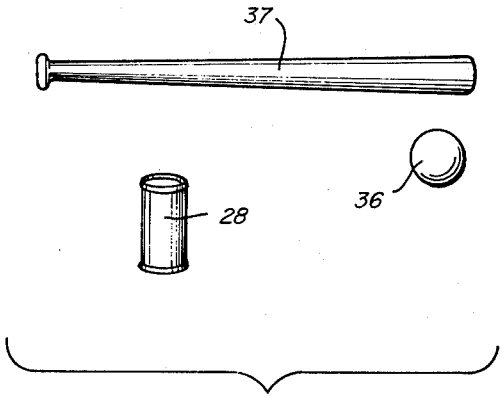
FIG. 2
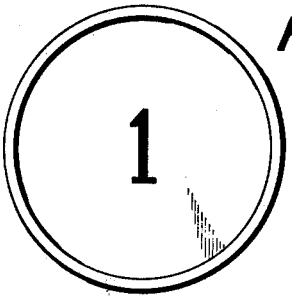
FIG. 3
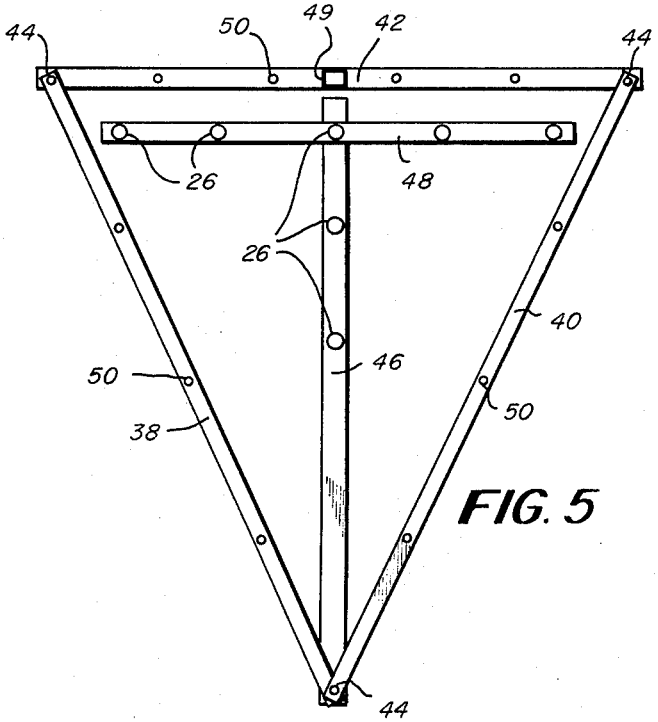
FIG. 5
FIG. 4
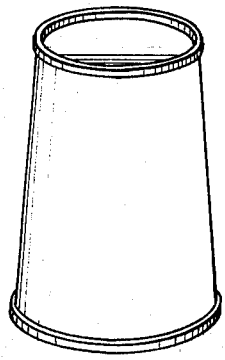

PLAYING FIELD AND BATTING APPARATUS

SUMMARY OF THE INVENTION

This invention relates to a baseball-like game which may be played by any number of people on a team. In one embodiment of the invention the apparatus includes a triangular sheet marked to define a pair of divergent foul lines and a base or defensive line opposite the apex of the foul lines. Indicia are located on the sheet to identify a plurality of locations at which cans or other suitable objects capable of being knocked over may be placed. The indicia are arranged in a T-shaped configuration. The apparatus also includes a ball and bat which may be lightweight and made from plastic. Means also are provided to secure the sheet to the ground. In general, the object of the game is for the batter to bat the ball and knock over one or more cans thereby scoring runs or points.

In an alternative embodiment of the invention, elongate strips of material are employed to define the foul lines and base line. The strips are of a predetermined length and are connectable to define the triangular region. Additional strips may be employed to facilitate proper placement of the cans in their T-shaped configuration.

The sheet or strips may be folded or rolled up in a compact configuration for easy packaging, display or storage.

It is among the objects of the invention to provide a baseball-like game and apparatus therefor which, is not limited to a minimum or maximum number of players.

Another object of the invention is to provide a game of the type described which can be played in relatively small areas, such as a backyard, as well as at beaches, playgrounds or the like.

A further object of the invention is to provide a game of the type described which can be played by persons of widely varied ages.

Another object of the invention is to provide a game of the type described which is inexpensive.

Still another object of the invention is to provide a game of the type described which can be easily compacted for packaging or storage.

DESCRIPTION OF THE DRAWINGS

The foregoing and other objects and advantages of the invention will be appreciated more fully from the following further description thereof, with reference to the accompanying drawings wherein:

FIG. 1 is a plan view of the triangular sheet laid out on a flat surface;

FIG. 2 is an illustration of the remaining elements of the apparatus including a typical can, a bat and a ball;

FIG. 3 is an end view of the can;

FIG. 4 is an illustration of a modified form of can which can be nested with the other cans of the apparatus;

FIG. 5 is an illustration of a modified form of the invention in which elongate strips are employed to define the triangular region.

DESCRIPTION OF THE PREFERRED EMBODIMENT

Figure 6:
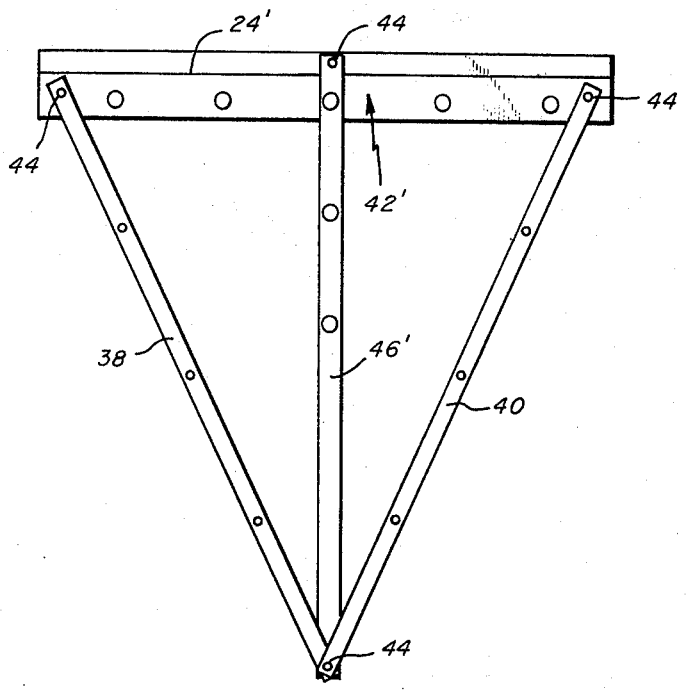
FIG. 6 is an illustration of a modified form of the embodiment shown in FIG. 5.

FIG. 1 shows the triangular sheet 10 in plan as it would appear when laid out on a flat playing surface.

The sheet 10 may be fabricated from thin sheet plastic capable of being folded and/or rolled up to a compact configuration. In the embodiment shown, the sheet is of generally isosceles triangular shape having side edges 12, 14 and a base edge 16. By way of example, the side edges 12, 14 may be of the order of 17 feet long and the base edge approximately 15 to 17 feet long. Thus, the triangular sheet may be of isosceles or equilateral configuration. The sheet 10 has a pair of foul lines 18, 20 formed thereon which extend from the apex 22 of the sheet along the side edges 12, 14 to the base edge 16. The foul lines may be defined by imprinting them on the sheet 10 with a suitable ink compatible with the sheet material or may be in the form of strips or a string attached to the sheet. The foul lines 18, 20 preferably are disposed inwardly approximately 6 inches from their respective side edges 12, 14. The base edge 16 of the sheet also may be imprinted or otherwise suitably marked to define the defensive or base line 24.

The region of the sheet defined within the foul lines 18, 20 and the base line 24 is provided with indicia, such as the circles indicated at 26 to facilitate proper placement of the cans 28 (later described). In the embodiment shown, there are seven such circles which are arranged in two rows along two intersecting lines (suggested in phantom at 30, 32) which define a generally T-shaped configuration. One of the rows 32 of indicia 26 parallels the base line 24 and the other row of indicia extends along a line 30 perpendicular to the base line 24 and which bisects the angle defined by the foul lines 18, 20. The circle 26 which is nearest to the apex 22 is spaced from the apex 22 by an amount which is preferably slightly more than half of the distance from the apex 22 to the base edge 16. Thus, in the embodiment shown, it would be desirable to locate the nearest circle nine feet from the apex 22. The spacing between each pair of adjacent indicia 26 in each row is the same and, in the illustrative embodiment, may be three feet. If desired, in order to insure that the sheet remains secured to the ground and is not lifted up by the wind, the corners and edges of the sheet may be provided with reinforced grommets 34 through which a stake may be driven to hold the sheet 10 in place.

A typical can, indicated at 28 in FIG. 2, may be of the order of size of a twelve ounce beverage can and, if desired, may actually be such a can. The can preferably is lightweight so that it can be knocked over easily if it is hit by the batted ball 36. If desired, the cans 28 may have indicia of value, signifying a number of runs or home runs, singles, doubles, triples or other like baseball oriented values. The indicia may be formed on the bottom of the can, as suggested in FIG. 3, so that the defensive team can place the cans 28 on the indicia 26 so that the offensive team will not know whether a particular can 28 has a high or low value until that can has been knocked over. This may be employed to introduce an element of chance in the game if desired.

In the preferred embodiment there are seven cans or the like capable of being knocked over and the use of the T-shaped configuration shown has been found to provide the most playable and best results. With the configuration shown, it is sometimes possible to knock over two or even three cans with a single batted ball.

Because the game is intended to be capable of being played in a relatively small area, the ball 36 and bat 37 should be selected so that even when the ball is hit very hard, it will not travel too far, too fast or with too much momentum. To this end, the bat 37 preferably is of light plastic construction and the ball 36, similarly, may be of light plastic construction. It may be noted that where the bat is relatively light, the use of a heavier ball, for example, a regulation softball, may be satisfactory because the bat would be incapable of hitting the softball too hard or too fast. Conversely, a heavier bat may be employed, depending on the characteristics of the ball, where the ball is incapable of being hit too hard, for example, as if made from foam plastic.

In play, the members of the defensive team are beyond the base line 24 and the batter, on the opposing team, stands to one side of and/or behind the apex of the sheet as suggested by the phantom batters' line 39 in FIG. 1. The ball is pitched by one member of the defensive team who is located along the center line of the triangle. The other members of the defensive team are positioned to either side of and, depending on their number, behind the pitcher.

FIG. 5 illustrates a modified embodiment of the invention in which, instead of employing a continuous triangular sheet to define the active play area, a plurality of strips are employed. The strips may be made from plastic, cloth or other suitable material. There are two strips 38, 40 which are employed to define the foul lines and a third strip 42 which defines the base or defensive line. The ends of each strip preferably include disconnectable fasteners 44, such as conventional snaps by which the ends of the strips can be connected together in the triangular configuration. Alternatively, the fasteners 44 may take the form of simple reinforced grommets which can be aligned and staked into the ground by a suitable stake which will also serve to hold the strips in place. The foul lines may be imprinted on the strips or the strips, themselves, may be considered as defining the foul lines. In order to facilitate proper placement of the cans within the traingle defined by the strips 38, 40, 42, supplementary strips 46, 48 may be employed to define the T-shaped oriented indicia 26 for the cans, the strips 46, 48 having circles or other suitable indicia formed thereon. One of the strips 46 may extend from the apex to the base strip 42 and, if desired, the base strip 42 may be marked within an indication 49 indicating that the strip 46 is centered properly. The transverse strip 48 which is near the defensive line can be visually aligned to parallel the base strip 42. The strips 38–42 and 46, 48 also may be provided with reinforced grommets 50 for receiving small stakes and to facilitate relatively permanent location of the strips on the playing surface.

FIG. 6 illustrates a modified form of the embodiment shown in FIG. 5 in which the separate transverse strip 48 is omitted. As shown, the base strip 42' may be of increased width, particularly at its side which is nearer the apex of the arrangement. The indicia can be formed on the widened base strip 42' itself. The center strip 46' extends fully to and overlaps the base strip 42' and is secured thereto by a suitable fastener 44.

The rules of play may, of course, be varied as desired. For example, there may be three outs to a side and one strike or two foul balls may make one out. If the batted ball knocks over one or more of the cans, the scoring can depend on the value at the bottom of the cans and, the defensive team can place the cans so that the values at the different spot locations can be varied from inning to inning so that the batter does not know which can has the highest value until the cans are knocked over. Alternatively, each can may simply be considered as scoring a single run when knocked over. If the ball stops in the triangular area but without knocking over a can, that may be considered as an out. If the ball is caught by the defensive team on the fly, that may be considered as a triple play. If the ball is hit over the defensive base line, on the fly and without being caught, that may be considered as a double play. It should be noted that these rules may be varied although it is noted that they have been found to be satisfactory in that they do not emphasize the batter's strength. This makes the game enjoyable for a wide variety of persons of different age and size including adults as well as small children.

The entire apparatus can be packaged in a compact configuration. In the first described embodiment, the sheet can be folded and/or rolled up. In the second and third described embodiments, the strips also can be separated and rolled up. In this regard, it may be noted that the "cans" may be provided with an open end receptive to one of the rolled-up strips. Also, the cans may be of frusto-conical shape as suggested in FIG. 4 thus permitting them to be nested to further compact the apparatus. Also, the bat, if desired, may be of telescoping construction.

It should be understood that the foregoing description of the invention is intended merely to be illustrative thereof and that other modifications and embodiments may be apparent to those skilled in the art without departing from its spirit.

Having thus described the invention, what I desire to claim and secure by Letters Patent is:

1. A game apparatus comprising: a ball; a bat; means defining a triangular area having at least two sides of equal length;

means defining a plurality of indicia within the triangular area, said indicia being spaced along two perpendicular lines which define a T-shaped configuration, one of the lines being parallel to the third side of the triangular area and the other line extending along the bisector of the angle between the first two mentioned sides;

a plurality of members, equal in number of the number of indicia, said members being adapted to be placed on the indicia in said T-shaped array, said members each being so constructed and arranged as to be able to be knocked over when impacted by said ball; and the indicia nearest the apex defined by the first two sides being located at a position which is spaced from the apex more than one half of the distance from the apex to the third side of the triangular area.

2. An apparatus as defined in claim 1 further comprising:

each pair of adjacent indicia being equally spaced from other pairs of adjacent indicia as measured along said lines.

3. An apparatus as defined in claim 1 wherein the members have indicia of value located on their bottoms.

4. An apparatus as defined in claim 1 further comprising:

a sheet of flexible material foldable to a compact configuration;

a pair of foul lines located on the sheet, the foul lines defining said two sides of equal length of the triangular area and a third base line located on the sheet and extending between the spaced ends of the foul lines; and means for securing the sheet to the ground surface at a plurality of locations.

5. An apparatus as defined in claim 4 wherein the members are of generally conical shape and are nestable.

6. An apparatus as defined in claim 1 wherein the means defining the triangular area comprises three elongate strips, at least two of which are of the same length, the strips being detachably connectable end-to-end to define the triangular area; and supplemental strips having said indicia formed thereon, said supplemental strips being arrangeable in said T-shaped configuration.

7. An apparatus as defined in claim 6 wherein the members are of generally frusto-conical configuration having an open end and being nestable within each other.

8. A game apparatus comprising:

means defining a triangular area having at least two sides of equal length;

means defining a plurality of indicia within the triangular area, said indicia being spaced along two perpendicular lines which define a T-shaped configuration, one of the lines being parallel to the third side of the triangular area and the other line extending along the bisector of the angle between the first two mentioned sides;

a plurality of members, equal in number of the number of indicia, said members being adapted to be placed on the indicia in said T-shaped array, said members each being so constructed and arranged as to be able to be knocked over when impacted by a ball;

the indicia nearest the apex defined by the first two sides being located more than one half of the distance from the apex to the third side of the triangular area; and a ball and a bat, said ball and bat being constructed and arranged to limit the distance and speed which the batted ball may travel.

* * * * *